US006195404B1

(12) United States Patent
Lemogne et al.

(10) Patent No.: US 6,195,404 B1
(45) **Date of Patent: *Feb. 27, 2001**

(54) ANTI-RADIATION DEVICE FOR CONTAINERS USED TO SHIP RADIOACTIVE MATERIALS

(75) Inventors: Andre Lemogne, Ermont; Dominique Francois, Bry sur Marne, both of (FR)

(73) Assignee: Societe pour les Transports de l'Industrie Nucleaire - Transnucleaire, Paris (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/258,804

(22) Filed: Feb. 26, 1999

(30) Foreign Application Priority Data

Mar. 13, 1998 (FR) ..... 98 03331

(51) Int. Cl.[7] ..... G21C 19/07; G21F 5/00
(52) U.S. Cl. ..... 376/272; 250/506.1
(58) Field of Search ..... 376/272; 250/506.1, 250/507.1

(56) References Cited

U.S. PATENT DOCUMENTS

| | | | | |
|---|---|---|---|---|
| 3,111,586 | * | 11/1963 | Rogers | 250/108 |
| 4,339,411 | | 7/1982 | Knackstedt et al. | 376/272 |
| 4,388,268 | | 6/1983 | Knackstedt et al. | 376/272 |
| 4,535,250 | * | 8/1985 | Fields | 250/507.1 |
| 4,752,437 | * | 6/1988 | Ito et al. | 376/272 |
| 4,783,309 | | 11/1988 | Popp et al. | 376/272 |
| 5,641,970 | * | 6/1997 | Taniuchi et al. | 250/506.1 |
| 5,887,042 | * | 3/1999 | Akamatsu et al. | 376/272 |

FOREIGN PATENT DOCUMENTS

| | | |
|---|---|---|
| 0087350 | 8/1983 | (EP) . |
| 2033287 | 5/1980 | (GB) . |

* cited by examiner

*Primary Examiner*—Charles T. Jordan
*Assistant Examiner*—Kyongtaek K. Mun
(74) *Attorney, Agent, or Firm*—Dennison, Scheiner, Schultz & Wakeman

(57) ABSTRACT

An anti-radiation device for a container adapted to receive radioactive materials, the device including a plurality of individual and adjacent tubular metal housings, each of the housings having an internal wall shaped to enable flush contact with an outer wall of the container, side walls shaped to enable flush contact with an adjacent tubular housing and an external wall. Each metal housing of the device is fastened to the outer wall of the container.

17 Claims, 1 Drawing Sheet

ANTI-RADIATION DEVICE FOR CONTAINERS USED TO SHIP RADIOACTIVE MATERIALS

FIELD OF THE INVENTION

The present invention relates to an anti-radiation shielding device that is installed on the outer surface of containers used to ship or store radioactive materials in order to ensure safety.

DESCRIPTION OF THE RELATED ART

Containers for radioactive materials generally comprise an elongated envelope that comprises a cylindrical body and leaktight sealing means used to close the container at both ends. The internal cavity contained within said envelope houses said radioactive materials, particularly irradiated fuel assemblies or vitrified waste.

The envelope must be capable of withstanding even the most violent mechanical impact, provide biological protection against radiation and ensure thermal transfer in order to release heat created by the radioactive materials.

Usually the cylindrical body is mainly constituted by a thick metal ring that is manufactured, for example, using cast or forged steel, cast iron or layers of various metals. The thickness of the body can be as much as several tens of centimeters (i.e. 20, 30 cm etc.) and the container can weigh between 100 and 150 tonnes.

The body often comprises fins on the outer surface that are used to disperse the heat more effectively into the atmosphere.

The fins can be fastened using bolts or welding or they can be shaped at the same time as the container is cast.

The thick metal body provides most of the biological protection but is generally insufficient to ensure complete neutron protection.

Therefore, in order to improve said neutron protection techniques are known where the body is covered with a neutron absorbing material, for example light solid resins, that are generally poured between the fins such that said fins remain a sufficient size suitable for thermal release.

In order to avoid the resins aging, techniques are also known whereby the resins are isolated from the external atmosphere by being contained within chambers or housings located on the body and equipped with cooling fins.

British patent application 2033287, for instance, describes the use of hollow chambers of this kind that are manufactured in a suitable heat conducting material, said chambers being filled with a material that forms a neutron shield and equipped with cooling fins surrounding the body. The chambers are shaped in such a way that they lie side by side and overlap each other. Said chambers are mounted on removable belts that surround the outer surface of the container and are not fitted directly onto the chamber.

French patent application 2521764 describes a particular embodiment of the type of protection that uses chambers filled with a material constituting a neutron shield, as mentioned above. The chambers are composed of elongated sections that are open along their length and have a V-shaped cross section that forms an obtuse angle. The sections are fitted side by side parallel to the axis of the container and in close thermal contact with the metal barrel. Said sections are then welded to said barrel and to each other such that they constitute said elongated closed chambers. The outer surface of the chambers are fitted with fins.

Once the chambers are positioned on the barrel they are individually filled with a neutron absorbing resin that is poured through the open end.

Although the chambers adequately protect and contain material that is used as a neutron shield, they require particularly long and expensive production methods. The chambers require a large amount of welding and filling once said chambers are already fastened onto the barrel of the container. Many difficult operations involving maneuvering an extremely heavy weight (between 100 and 150 tonnes, as mentioned above) are therefore needed. These operations cause a significant increase in the duration of manufacture.

The applicant has therefore invented a shielding apparatus using chambers that are more simply produced in order to reduce the cost and also to improve safety during operations to manufacture the chambers, to fasten them directly onto the barrel and fill them with a radiation absorbing material, and also to improve contact and thermal release. The applicant has also invented a simpler and safer method for positioning said shielding apparatuses.

Moreover, in examples that are more and more common, where the burnup rates of combustible assemblies have increased, the radioactive emissions of irradiated assemblies and waste are increased to the same extent. The containers intended for their use therefore require reinforced biological protection. In order to absorb the additional neutron emissions it is possible to increase the thickness of the absorbing material. It is not always possible, however, to absorb gamma rays by increasing the thickness of the steel barrel as this would lead to a reduction in the capacity of the container and an increase in weight or volume. These increases must be taken into consideration as the containers must remain suitable for transport on the public highway.

It may therefore be understood that dense metal (lead for example) is preferred which is inserted in layers between the barrel and the neutron absorber.

Therefore, the applicant has also invented an apparatus that is simple to implement and that enables the biological protection of the containers to be increased.

SUMMARY OF THE INVENTION

The invention relates to an anti-radiation device that is intended for containers used to transport and/or store radioactive material, said apparatus comprising a plurality of adjacent metal chambers that are fastened onto the outer surface of the container and that are filled with at least one neutron absorbing material, characterized by the fact that each chamber mainly comprises a tubular metal section built as a single part that is essentially closed along its length.

The container of to the invention generally comprises a long, thick, cylindrical metal barrel on the outer surface of which are fastened a plurality of tubular sections that are open or closed and built in a single piece.

Said section typically comprises a straight, closed polygonal cross-section, preferably with 4 sides that correspond to 4 longitudinal surfaces, and may be closed at the ends. Said section is usually produced using forward extrusion and does not include longitudinal welding or other closing means. The absence of longitudinal welding or other equivalent closing means results in the chamber being completely leaktight and not subject to deterioration with time. It is indispensable that the resin will not deteriorate and that it will preserve all its qualities as a neutron shield under any circumstances.

Said section is generally metal, preferably of a good heat conductor such as aluminum or aluminum alloys, copper or copper alloys etc. It is fastened onto said outer surface of the barrel parallel to the axis, usually using bolts, such that good thermal contact is created between said chamber and said barrel and between the adjacent chambers. The assembly of adjacent chambers generally covers all the outer surface of the barrel.

The outer surface of the chamber that is in contact with the outside air is advantageously provided with cooling fins that are extruded in a single piece with the section or fastened onto said section using any other means.

The close contact provided by a large contact surface between the section and the barrel improves the heat release.

The section is filled with a neutron shielding material that is achieved, for example, by pouring a hydrogen-rich resin into the section.

However, the invention is mainly advantageous when it is necessary to increase protection against gamma rays. It is then extremely simple to insert at least one metal plate inside each section constituting the chamber before said chamber is filled with resin and fastened to the container. Said metal plate is usually of a heavy metal such as lead or lead alloys or layers of various selected metals that are assembled such that they achieve both optimal biological protection and suitable assembly rigidity. Each plate is located as near as possible to the surface of the container, in other words usually in contact with the surface of the section that bears on the barrel. Generally, a lead plate is used that is covered by a steel protective sheet in order to facilitate fastening. Said fastening is generally achieved using bolts that pass through the steel and lead plates and the surface of the chamber that is in contact with the barrel, said bolts being screwed into said barrel. An apparatus of this kind enables the lead plate to be held in place in the event of an impact thereby avoiding said plate bearing directly onto the surfaces of the chamber and possibly distorting them.

The invention also relates to an anti-radiation apparatus that is intended for containers used to transport and/or store radioactive material, said apparatus comprising a plurality of adjacent metal chambers that are fastened onto the outer surface of the container and that are filled with at least one neutron absorbing material, characterized by the fact that at least one biological shielding material is inserted in the chamber and that said chamber containing the biological shielding material is then fastened onto the outer surface of said container.

Therefore, the positioning of the apparatus according to the invention is extremely simple and can be performed in two stages. First of all the plate made of lead and/or any other metal is optionally installed, then the said neutron shielding material is poured directly inside the section. The section prepared according to this method is then fastened onto the barrel of the container.

However, another possible method exists: once the metal plates have been optionally installed in the chamber, which is the most difficult operation, the section prepared as above can be fastened onto the barrel and then filled with the neutron shielding material.

Yet another, more standard method is also possible: in the event of a metal plate not being used, the section can be fastened first of all and then filled with the neutron shielding material.

It may be noted that in these examples no welding is required to close the chamber longitudinally or to fasten it to the barrel. Assembly is therefore facilitated and costs are reduced. The operations needed to equip and fill the chamber can also be achieved by operating separately on the section before it is fastened to the barrel. Said operations are therefore rendered easier and safer.

Operations for bolting the chamber onto the barrel are made possible using slots cut into the surface of the section opposite the surface that is in contact with the barrel. Said slots can then be suitably refilled. When it is intended that the resin be poured into the chamber before it is fastened, it is advantageous to install passage tubes at right angles to said slots in order to maintain an opening in the resin for the bolting. Once fastened, the empty spaces can be refilled with resin.

It may also be noted that the installation of lead plates in an apparatus such as that in French patent 2521764 previously referred to would be difficult to implement since the associated operations would have to be carried out when the chamber is already fitted with said chambers.

DESCRIPTION OF THE PREFERRED EMBODIMENT

Figure 1A:
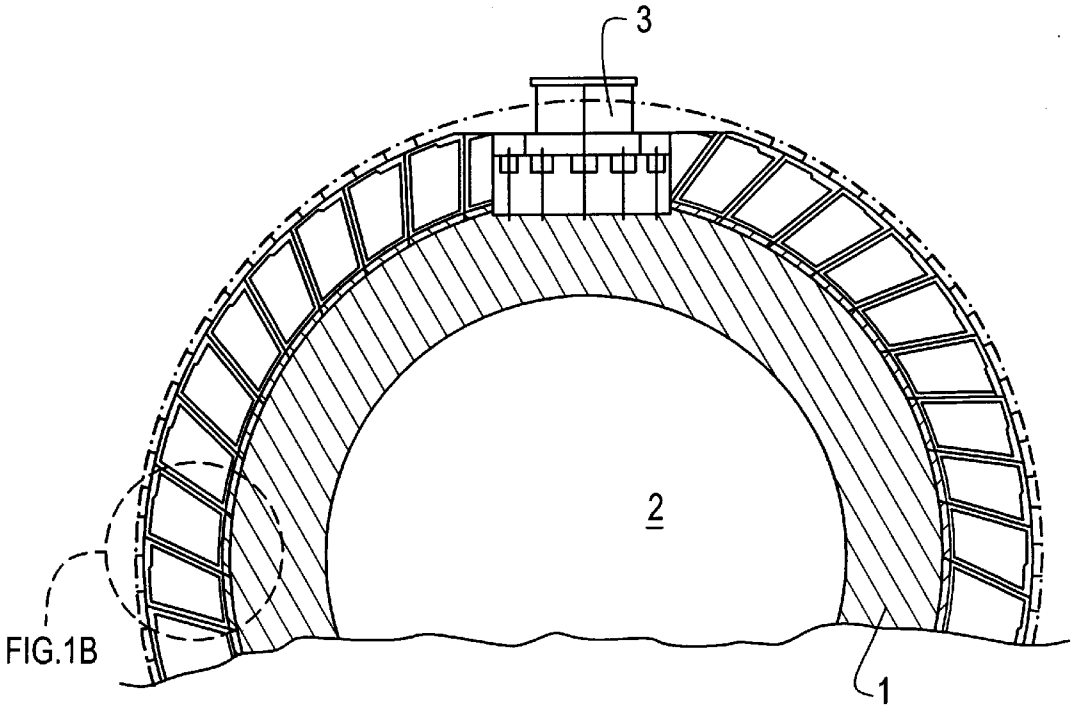
FIG. 1 is a partial, cross-sectional view of a container with an anti-radiation device according to the invention, including an enlarged portion of the device.
Figure 1B:
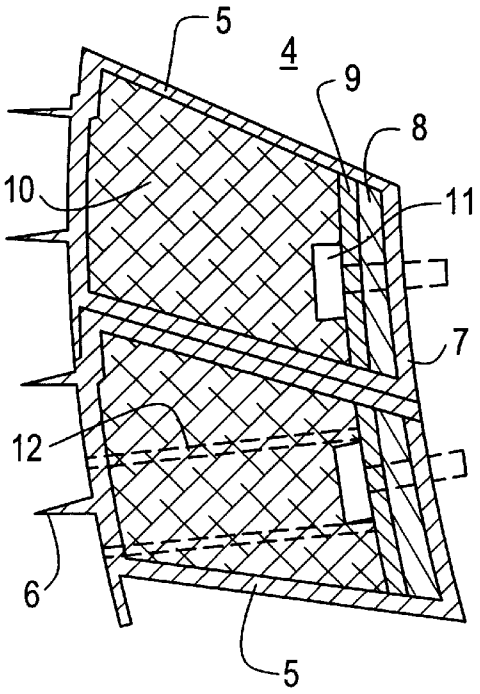

FIG. 1 shows the apparatus of the invention. It shows a container for radioactive material seen in cross-section and the detail of another cross-section view of two adjacent chambers according to the invention.

(1) is the thick metal barrel, usually made of steel, that constitutes the body of the container in cavity (2) in which the radioactive material is stored. The container is handled using trunnions (3) that are fastened onto barrel (1). A plurality of chambers (4) according to the invention cover the outer surface of barrel (1).

Each chamber mainly comprises a metal section (5) that is hollow and closed along its length and has 4 long surfaces. Cooling fins (6) are located on the outer surface of said sections. Internal surface (7) is molded to the outer surface of barrel (1) such that it ensures perfect thermal contact.

Inside each chamber a lead plate (8) is installed in contact with internal surface (7). The plate is covered with a protective steel sheet (9). The assembly consisting of section (5) and plates (8, 9) is fastened to barrel (1) using bolts (11). The remaining space inside section (5) is filled with a resin (10) that constitutes a neutron shield. Contained within (12) a passage tube may be seen that enables fastening from the outer surface of section (5) through the resin when said resin has been poured in section (5) before said section is fastened.

What is claimed is:

1. An anti-radiation device for a container adapted to receive radioactive materials, said device comprising a plurality of individual, separable and adjacent tubular metal housings, each of said housings comprising an internal wall shaped to enable flush contact with an outer wall of the container, side walls shaped to enable flush contact with a side wall of an adjacent tubular housing, an external wall, and means for individually fastening each of said housings to the outer wall of the container.

2. The device of claim 1, wherein each said housing is constructed from at least one metal selected from the group consisting of aluminum, copper, and alloys thereof.

3. The device of claim 1, additionally comprising cooling fins disposed on the external wall of at least one of said housings.

4. The device of claim 1, wherein the fastening means comprises bolts.

5. The device of claim 1, wherein each said housing is closed along its length.

6. The device of claim 1, wherein each said housing is filled with a resin.

7. The device of claim 1, wherein each said housing has a polygonal shape in cross-section.

8. The device of claim 7, wherein each said housing has a quadrilateral shape.

9. The device of claim 1, wherein each of said housings comprises a metal plate forming a gamma ray shield which is disposed within the housing as close as possible to the outer wall of the container.

10. The device of claim 9, wherein the metal plate is made of a heavy metal.

11. The device of claim 10, wherein the heavy metal is lead or a lead alloy.

12. An anti-radiation device for a container adapted to receive radioactive materials, said device comprising a plurality of individual, separable and adjacent tubular metal housings, each of said housings comprising an internal wall shaped to enable flush contact with an outer wall of the container, side walls shaped to enable flush contact with a side wall of an adjacent tubular housing, and an external wall, a first metal plate forming a gamma ray shield and disposed inside each said housing in contact with said internal wall, a protective metal plate covering each said first metal plate, a neutron absorbing material filling remaining space inside each said housing, and means for individually fastening each said housing with first and protective metal plates to the outer wall of the container.

13. An anti-radiation device for a container adapted to receive radioactive materials, said device comprising a plurality of separable, adjacent housings and at least one neutron absorbing material filling said housings, each said housing being formed as a single tubular metal part closed along its length and constructed and arranged to be individually fastened to the container.

14. An anti-radiation device for a container adapted to receive radioactive materials, comprising a plurality of adjacent chambers including at least one neutron-absorbing material filling said chambers, each of said chambers being formed of a single and separate tubular metal part closed along its length, a heavy metal plate and a protective metal plate being received within each of said chambers, each of said tubular metal parts including a heavy metal plate and said protective metal plate being adapted to be individually secured by bolt means to the container, whereby said protective metal plate covers the heavy metal plate, and the heavy metal plate is in contact with an internal wall of the tubular metal part.

15. A container for receiving radioactive materials, comprising a barrel having an outer surface, and an anti-radiation device secured to said outer surface, said anti-radiation device comprising a plurality of adjacent chambers, each of said chambers formed by a single and separate tubular metal part having an internal wall, a first metal plate forming a gamma ray shield disposed within each said chamber in contact with said internal wall, a protective metal plate covering the first metal plate, a neutron absorbing material filling remaining space within each said chamber, and bolt means individually securing each said tubular metal part, first metal plate and protective metal plate onto the outer surface of the barrel.

16. A container for receiving radioactive materials, comprising a barrel having an outer surface, an anti-radiation device secured to said outer surface and comprising a plurality of adjacent chambers and at least one neutron absorbing material filling said chambers, each said chamber being formed of a single and separate tubular metal part closed along its length, each single tubular metal part having an inner wall fastened individually to the outer surface of the barrel.

17. A container for receiving radioactive materials, comprising a barrel having an outer surface and an anti-radiation device secured to the outer surface, said device comprising a plurality of adjacent chambers and at least one neutron absorbing material filling said chambers, each said chamber formed by a single and separate tubular metal part closed along its length, a heavy metal plate and a protective metal plate being received within each chamber, bolt means individually fastening each tubular metal part, heavy metal plate and protective plate received within the chamber to the outer surface of the barrel, whereby the protective metal plate covers said heavy metal plate, and the heavy metal plate is in contact with an internal wall of the tubular metal part.

* * * * *